US009487036B2

(12) United States Patent
Ishida

(10) Patent No.: US 9,487,036 B2
(45) Date of Patent: Nov. 8, 2016

(54) CUTTER BLADE DRIVE MECHANISM, CUTTER, AND PRINTER

(71) Applicant: Seiko Epson Corporation, Tokyo (JP)

(72) Inventor: Tetsugo Ishida, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/968,105

(22) Filed: Dec. 14, 2015

(65) Prior Publication Data

US 2016/0185140 A1 Jun. 30, 2016

(30) Foreign Application Priority Data

Dec. 25, 2014 (JP) ..... 2014-261882

(51) Int. Cl.
*B41J 11/70* (2006.01)
*B26D 1/06* (2006.01)
*B26D 5/08* (2006.01)

(52) U.S. Cl.
CPC ..... *B41J 11/70* (2013.01); *B26D 1/065* (2013.01); *B26D 5/083* (2013.01)

(58) Field of Classification Search
CPC ..... B41J 11/70; B41J 11/703; B41J 11/706; B41J 11/66; B41J 11/663; B26D 1/15; B26D 1/151; B26D 1/01; B26D 1/16; B26D 1/165; B26D 1/065; B26D 1/00; B26D 5/083; B26D 5/08
See application file for complete search history.

(56) References Cited

U.S. PATENT DOCUMENTS 6,152,007 A 11/2000 Sato
2007/0296799 A1 * 12/2007 Watanabe ..... B26F 1/18 347/222

FOREIGN PATENT DOCUMENTS

JP 10-217182 A 8/1998
JP 2005-161481 A 6/2005
JP 2005-324301 A 11/2005
JP 2006-075935 A 3/2006

* cited by examiner

*Primary Examiner* — Henok Legesse

(57) ABSTRACT

A cutter blade drive mechanism reliably returns a cutter blade from a forward position to a retracted position. A rotation transfer mechanism 34, which transfers rotation of a drive motor 31 to a drive gear 32, has a cutter blade return gear 50 that meshes with the drive gear 32, a compound gear 40 to which rotation from the drive motor 31 is transferred, and a transfer gear 51 that meshes with the compound gear 40 and the cutter blade return gear 50. While an intermittent teeth part 43*a* of the compound gear 40 and the transfer gear 51 are meshed, the cutter blade 21 moves to the forward position 21A. When the intermittent teeth part 43*a* and the transfer gear 51 are not meshed and the compound gear-side protrusion 44*b* of the compound gear 40 is in contact with a cutter blade return protrusion 50*b* of a cutter blade return gear 50, the cutter blade return gear 50 rotates in unison with the compound gear 40, the drive gear 32 turns in the opposite direction, and the cutter blade 21 returns to the retracted position 21B.

13 Claims, 8 Drawing Sheets

CUTTER BLADE DRIVE MECHANISM, CUTTER, AND PRINTER

BACKGROUND

1. Technical Field

The present invention relates to a cutter drive mechanism and to a cutter that cut sheet media by reciprocally moving a cutter blade. The invention also relates to a printer having the cutter.

2. Related Art

A printer with a cutter is described in JP-A-H10-217182. The cutter in JP-A-H10-217182 has cutter blade drive mechanism that drives a cutter blade reciprocally between a forward position where the recording paper is cut and a retracted position separated from the forward position. The cutter blade drive mechanism has a drive motor, two cutter drive gears to which drive power is transferred from the drive motor, and a guide that guides the movable knife in the forward/back direction. The two cutter drive gears are arranged in a perpendicular direction perpendicular to the forward/back direction of motion (or travel) of the movable knife with their axes of rotation perpendicular to the plane of motion of the movable knife. The two cutter drive gears mesh together and rotate synchronously. Each cutter drive gear has a drive pin disposed to a position offset from the center of the end face. Oval holes with the long axis extending in the perpendicular direction are formed in the movable knife, and the drive pins of the cutter drive gears are inserted in these holes.

When the two cutter drive gears turn by the drive power from the drive motor, the drive pins move in the forward/back direction of the movable knife while moving in the perpendicular direction inside the oval holes. The drive pins therefore contact the sides of the oval holes and move the movable knife in the forward/back direction. When the cutter drive gears turn one revolution, the movable knife travels round trip to the forward position overlapping the fixed knife and then back to the retracted position forming a gap between the movable knife and the fixed knife. With the cutter blade drive mechanism described in JP-A-H10-217182, the drive motor stops after the movable knife returns from the forward position to the retracted position.

If the position where the drive motor stops varies with the cutter blade drive mechanism described in JP-A-H10-217182, the position of the movable knife will be offset from the retracted position by the amount of deviation in the position of the drive motor. If the movable knife returned to the retracted position is thus offset to the forward position side of the retracted position, and the movable knife is normally covered by a cover when at the retracted position, the cutting edge of the movable knife may be dangerously exposed from the cover. The stroke of the movable knife must therefore be increased so that the movable knife is positioned where it will be covered by the cover even when the position where the drive motor stops varies. Increasing the stroke of the movable knife may increase the size of the device, however.

SUMMARY

An objective of the present invention is to provide a cutter blade drive mechanism and cutter that can reliably return a cutter blade that cuts media at the forward position to a retracted position separated from the forward position. A further objective of the invention is to provide a printer having the cutter.

A cutter blade drive mechanism according to the invention that moves a cutter blade reciprocally between a forward position where a sheet medium is cut and a retracted position separated from the forward position has: a drive gear; a rotary-to-linear-motion conversion mechanism that converts rotation of the drive gear to linear motion moving the cutter blade forward and back; a drive motor; and a rotation transfer mechanism that transfers rotation from the drive motor to the drive gear. The cutter blade moves from the retracted position to the forward position by rotation of the drive gear by a first specific rotational angle in a first direction of rotation, and moves from the forward position to the retracted position by rotation of the drive gear by a second specific rotational angle in a second direction of rotation opposite the first direction of rotation.

Preferably, the transfer mechanism includes a cutter blade return gear that meshes with the drive gear, an intermittent gear to which rotation from the drive motor is transferred, and a transfer gear that transfers rotation of the intermittent gear to the cutter blade return gear. The cutter blade return gear also preferably has a protrusion at a position separated radially from its axis of rotation. The intermittent gear has a contact part at a position separated radially from its axis of rotation that can contact the protrusion.

In this aspect of the invention, the intermittent gear to which rotation of the drive motor is transferred has a contact part that can contact a protrusion for returning the cutter blade. While contact is maintained between the contact part of the intermittent gear and the protrusion of the cutter blade return gear, the cutter blade return gear can be turned together with the intermittent gear, and the drive gear can be turned in the second direction of rotation. The second rotational angle the drive gear turns in the second direction can be set (specified) to the desired rotational angle by appropriately setting a period during which contact is maintained between the contact part of the intermittent gear and the protrusion of the cutter blade return gear. The drive gear can therefore be turned only the second specific (i.e. specified) rotational angle while the contact part of the intermittent gear and the protrusion of the cutter blade return gear are touching, and the drive gear then stops. Because the cutter blade can thereby be stopped at the retracted position without stopping the drive motor, the cutter blade can be accurately stopped at the retracted position even if the position where the drive motor stops varies.

It is to be understood that the intermittent gear is not continuously meshed with the transfer gear, but the intermittent gear has a toothed part that intermittently meshes with a toothed part of the transfer gear. To move the cutter blade accurately between the forward position and the retracted position, the drive gear of the cutter blade drive mechanism turns the first specific rotational angle in the first direction of rotation in conjunction with rotation of the intermittent gear while the toothed parts of the intermittent gear and the transfer gear are meshed, and when the toothed parts of the intermittent gear and the transfer gear are not meshed and the contact part of the intermittent gear is in contact with the protrusion of the cutter blade return gear, the drive gear turns the second specific rotational angle in the second direction of rotation by the intermittent gear turning the cutter blade return gear.

Optionally, the magnitude (i.e. absolute value) of the first specific rotational angle may be substantially equal to the magnitude (i.e. absolute value) of the second specific rotation angle.

Further preferably, the protrusion is disposed closer to the outside circumference of the intermittent gear than the toothed part. As a result, the cutter blade can be moved from the forward position to the retracted position at a faster speed than the speed at which the cutter blade moves from the retracted position to the forward position.

Further preferably, the rotary-to-linear-motion conversion mechanism is a rack and pinion mechanism. By using a rack and pinion mechanism, the rotational angle of the drive gear and the linear speed of the movable knife can be desirably controlled, and the movable knife can be moved more accurately than when the rotary to linear conversion mechanism uses a linkage mechanism.

Further preferably, cutter blade drive mechanism also has an urging member that urges the cutter blade from the forward position to the retracted position. Thus comprised, the urging force of the urging member can assist moving the cutter blade from the forward position to the retracted position.

In another aspect of the invention, the drive gear also functions as the transfer gear.

In this aspect of the invention, the toothed part of the intermittent gear meshes with the drive gear, and rotation of the intermittent gear can be passed through the drive gear to the cutter blade return gear. Providing a transfer gear separately to the drive gear is therefore not necessary.

Another aspect of the invention is a cutter including: the cutter blade drive mechanism according to the invention; a first cutter blade that is moved between the forward position and the retracted position by the cutter blade drive mechanism; and a second cutter blade that contacts the first cutter blade at the forward position as the first cutter blade moves from the retracted position to the forward position.

With this aspect of the invention, because the first cutter blade can be moved accurately and reliably between the forward position and the retracted position, there is no need to provide the first cutter blade with a stroke that is longer than necessary. A small cutter can therefore be provided.

Another aspect of the invention is a printer including: the cutter according to the invention; a printhead; and a conveyance mechanism that conveys sheet media through a conveyance path passing the printing position of the printhead and the cutting position of the cutter.

Because a small cutter can be provided, a small printer with a cutter can be easily provided.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures.

General Configuration

Figure 1:
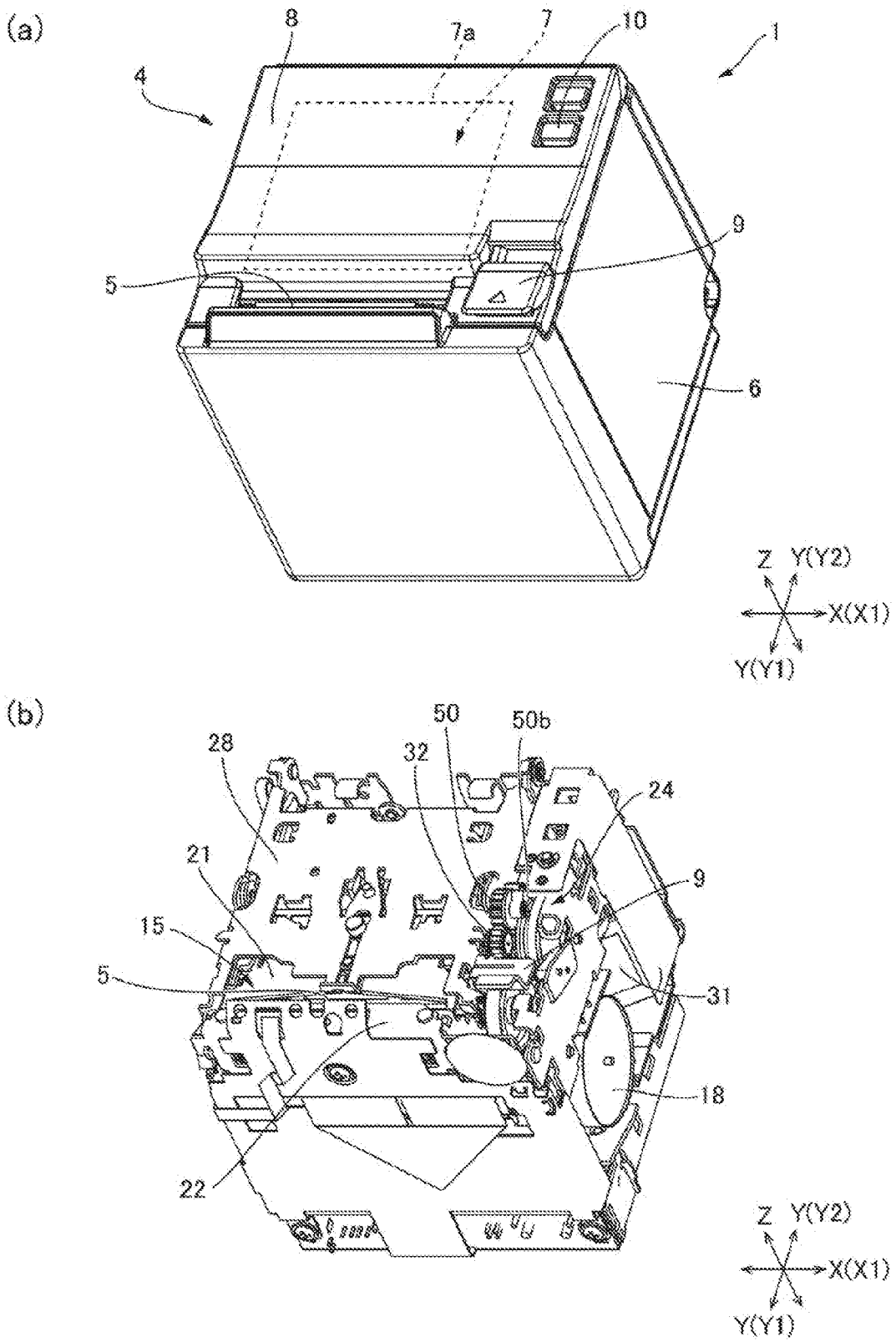
FIG. 1 is an oblique view of a printer according to the invention.
Figure 2:
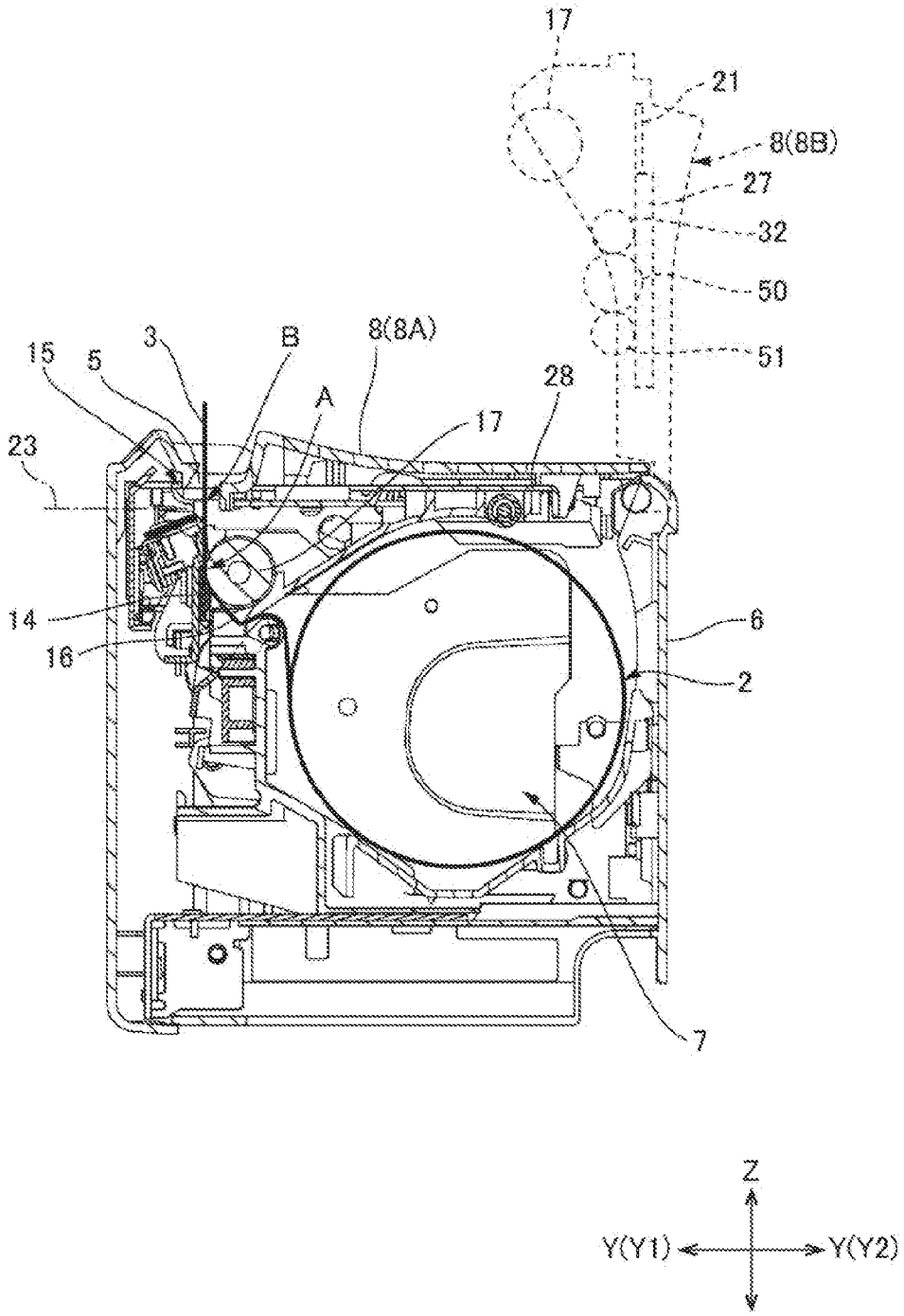
FIG. 2 is a schematic section view of the printer in FIG. 1.

FIG. 1, view (a) is an oblique view of a printer 1 according to an embodiment of the invention, and FIG. 1, view (b) is an oblique view of the printer 1 in view (a) without the outside case 4. FIG. 2 is a section view of the printer 1 in FIG. 1. The printer 1 in this example is a roll paper printer that prints on recording paper 3 delivered from a paper roll 2. As shown in FIG. 1, the printer 1 has a basically box-like printer case 4. A paper exit 5 from which the recording paper 3 is discharged is formed in the top front part of the printer case 4. The paper exit 5 extends widthwise to the printer 1. Note that three mutually perpendicular axes, a transverse axis X aligned with the printer width, a longitudinal axis Y, and a vertical axis Z, are used below.

The printer case 4 includes a box-like main case 6, and an access cover 8 that opens and closes the top of the main case 6. The main case 6 has a roll paper compartment 7 inside (see FIG. 2), and the cover 8 covers a roll paper loading opening 7*a* from above (above on the vertical axis Z).

The cover 8 is attached toward the back, Y2, of the printer 1 (Y2 identifies a direction toward the rear of printer 1 along the longitudinal axis Y) behind the paper exit 5. A release button 9 is disposed beside the cover 8 on one side, and preferably on a side toward a direction X1, where X1 identifies a right-ward direction along the transverse axis X when facing the front of printer 1 in FIG. 1. A power switch 10 is disposed behind the release button 9 toward the back, Y2. Operating the release button 9 unlocks the cover 8. When unlocked, the cover 8 can pivot on a spindle extending along the transverse axis X. The cover 8 moves between a closed position 8A (see FIG. 2) where the cover 8 is horizontal and closes the roll paper compartment 7, as shown in FIG. 1, and an open position 8B where the cover 8 is upright and the roll paper compartment 7 is open as indicated by the dotted line in FIG. 2.

As shown in FIG. 2, inside the printer case 4 are a printhead 14 and a cutter 15. Also inside the printer case 4 is the conveyance path 16 through which the recording paper 3 travels from the roll paper compartment 7, past the printing position A of the printhead 14, past the cutting position B of the cutter 15, and to the paper exit 5.

The printhead 14 is preferably a thermal head. The printing position A is defined by a platen roller 17 opposite the printhead 14. Torque from a conveyance motor 18 is transferred to the platen roller 17. The platen roller 17 and conveyance motor 18 (see view (b) in FIG. 1) embody the conveyance mechanism that conveys the recording paper 3 through the conveyance path 16.

The printer 1 drives the conveyance motor 18 to turn the platen roller 17 and convey the recording paper 3 set in the conveyance path 16 at a specific speed. The printer 1 also drives the printhead 14 to print on the recording paper 3 as it travels past the printing position A. The printer 1 also drives the cutter 15 to cut the recorded part of the recording paper 3 after printing is completed.

Cutter

Figure 3:
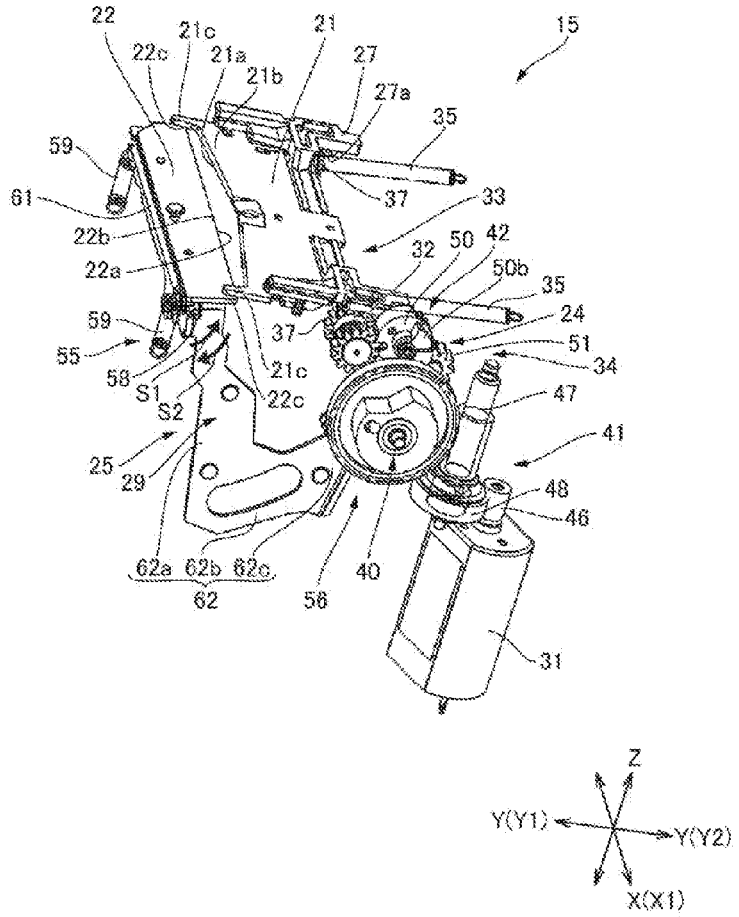
FIG. 3 is an oblique view of the cutter.
Figure 4:
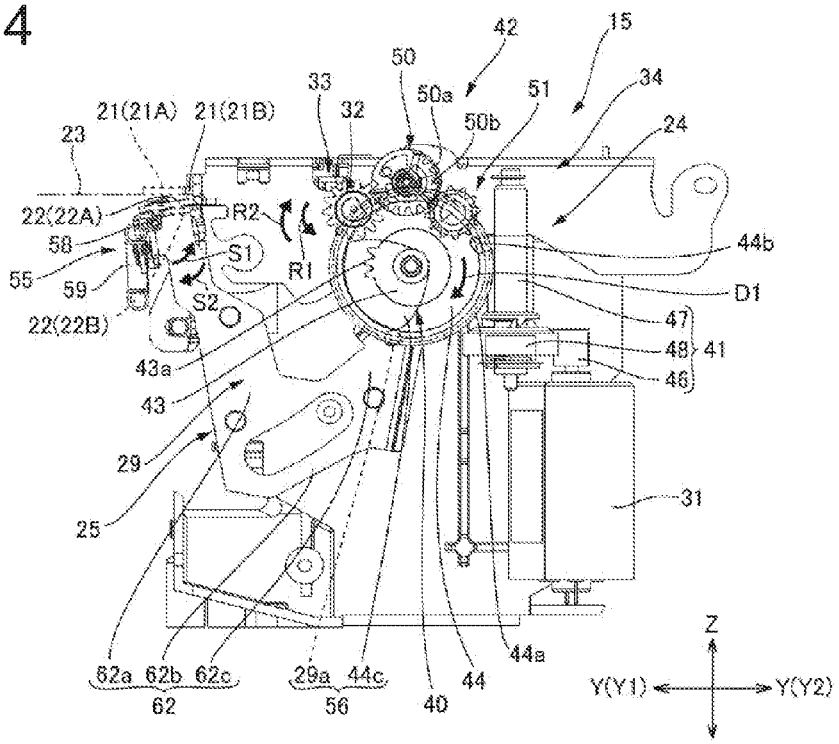
FIG. 4 is a side view of the cutter.

FIG. 3 is an oblique view of the cutter 15. FIG. 4 is a side view of the cutter 15. Note that the intermittent teeth of the compound gear, the compound gear-side protrusion and cam, and the cutter blade return protrusion of the cutter blade return gear are shown in FIG. 4 for easier understanding. As shown in FIG. 1, view (b) and FIG. 3, the cutter 15 has a first cutter blade 21 and a second cutter blade 22 that work together to cut the recording paper 3. The cutter 15 also has a first cutter blade moving mechanism 24 that moves the first cutter blade 21 along a predetermined plane of motion 23 (see FIG. 2 and FIG. 4). The plane of motion 23 is a plane that intersects the conveyance path 16 at the cutting position B below the paper exit 5 and is perpendicular to the vertical axis Z. As shown in FIG. 4, the first cutter blade moving mechanism 24 moves the first cutter blade 21 reciprocally between the forward position 21A where the recording paper 3 is cut, and a retracted position 21B separated from the forward position 21A.

The cutter 15 also has a second cutter blade moving mechanism 25 that causes the second cutter blade 22 to rock between a contact position 22A where the second cutter blade 22 slides against the first cutter blade 21 to cut the recording paper 3, and a release position 22B where the second cutter blade 22 is separated from the first cutter blade 21 (and separated from plane of motion 23).

The cutter 15 cuts the recording paper 3 on the conveyance path 16 at the cutting position B by moving the first cutter blade 21 from the retracted position 21B to the forward position 21A when the second cutter blade 22 is at the contact position 22A.

First Cutter Blade and Second Cutter Blade

As shown in FIG. 3, the cutting edge 21*a* of the first cutter blade 21 faces the front direction, Y1 (the front direction Y1 of the printer 1 along the longitudinal axis Y). The first cutter blade 21 is a flat blade with a plane shape that is left-right symmetrical (e.g. symmetrical about a bisecting line, preferably along the Y axis). The front edge of the first cutter blade 21 forms a V-shaped knife edge 21*b* that narrows toward the back direction Y2 at its center as determined on the transverse axis X. The first cutter blade 21 also has a pair of lift guides 21*c* that protrude to the front Y1 on opposite ends of the knife edge 21*b* on the transverse axis X. The lift guides 21*c* extend to a position resting on matching ends (seat parts 22*c*) of the second cutter blade 22 when seen from above along the vertical axis Z. The back end of the first cutter blade 21 is supported by a rack member 27. The cutter 15 blades and rack member 27 are supported by a cover side frame 28 (FIG. 1, view (b)), which can move on the longitudinal axis Y.

The cutting edge 22*a* of the second cutter blade 22 faces the cutting edge 22*a*. The second cutter blade 22 is a flat, rectangular blade that is long on the transverse axis X. The second cutter blade 22 has seat parts 22*c* on the back (the side facing the first cutter blade 21) at opposite ends on the transverse axis X. The lift guides 21*c* of the first cutter blade 21 slide in contact with the tops of the seat parts 22*c*. The knife edge 22*b* of the second cutter blade 22 extends in a straight line on the transverse axis X between the lift guides 21*c*. The second cutter blade 22 is carried by a support frame 29.

First Cutter Blade Moving Mechanism

As shown in FIG. 3, the first cutter blade moving mechanism 24 includes a drive motor 31 as the drive source, a drive gear 32, a rotary to linear conversion mechanism 33 for converting rotation of the drive gear 32 to linear motion and moving the first cutter blade 21 reciprocally on the plane of motion 23, and a transfer mechanism 34 for transferring rotation of the drive motor 31 to the drive gear 32. The first cutter blade moving mechanism 24 also has an urging member that urges the first cutter blade 21 from the forward position 21A side to the retracted position 21B. The urging member in this example is a coil spring 35.

The rotary to linear conversion mechanism 33 in this example is a rack and pinion mechanism. More specifically, the rotary to linear conversion mechanism 33 has a pinion 37 disposed coaxially to and rotating in unison with the drive gear 32, and a rack 27*a* disposed to the rack member 27 that supports the first cutter blade 21. The pinion 37 meshes with the rack 27*a*. The drive motor 31 is a DC motor, and is driven rotationally in one direction. In this example, the rotary to linear conversion mechanism 33 moves the first cutter blade 21 from the retracted position 21B to the forward position 21A by turning the drive gear 32 a specific angle of rotation in a first direction of rotation R1 (see FIG. 4). The rotary to linear conversion mechanism 33 also moves the first cutter blade 21 from the forward position 21A to the retracted position 21B by the drive gear 32 turning a specific angle of rotation in a second direction of rotation R2 that is opposite the first direction of rotation R1.

The transfer mechanism 34 includes a compound gear (intermittent gear) 40, an upstream transfer mechanism 41, and a downstream transfer mechanism 42. The upstream transfer mechanism 41 is positioned on the upstream side of the compound gear 40 on the transfer path of rotation from the drive motor 31, and the downstream transfer mechanism 42 is on the downstream side of the compound gear 40. The first cutter blade 21 travels round trip to the forward position 21A and back to retracted position 21B while the compound gear 40 is turned one revolution by driving the drive motor 31.

The compound gear 40 is supported on a rotary shaft extending along the transverse axis X below the plane of motion 23 of the first cutter blade 21. As shown in FIG. 4, the compound gear 40 has an intermittent gear part 43 and a large diameter gear part 44. The intermittent gear part 43 has intermittent teeth (toothed part) 43*a* formed through a specific angular range. The large diameter gear part 44 is larger in diameter than the intermittent gear part 43, and is formed coaxially to the intermittent gear part 43. The large diameter gear part 44 is located on the one side X1 (outside side) of the intermittent gear part 43 on the transverse axis X.

The large diameter gear part 44 has teeth (toothed part) 44*a* around the full outside circumference. The large diameter gear part 44 also has a compound gear-side protrusion (contact part) 44*b* that protrudes from the face on the intermittent gear part 43 side on the transverse axis X toward the intermittent gear part 43. The compound gear-side protrusion 44*b* is disposed closer to the outside circumference than the intermittent teeth part 43*a* of the intermittent gear part 43 and at a different angular position than the intermittent teeth part 43*a*. The compound gear-side protrusion 44*b* extends circumferentially through a specific angular range.

The compound gear 40 also has a cam 44*c*. The cam 44*c* is formed in unison with the intermittent teeth part 43*a* and large diameter gear part 44. The cam 44*c* and the compound gear-side protrusion 44*b* of the large diameter gear part 44 are also disposed to different angular positions.

The upstream transfer mechanism 41 has a pinion 46 disposed on the output shaft of the drive motor 31, a worm 47 to which rotation of the pinion 46 is transferred, and a clutch mechanism 48 between the worm 47 and the pinion 46.

The drive motor 31 is disposed with the output shaft on the vertical axis Z. The rotary shaft of the worm 47 is also on the vertical axis Z. The worm 47 meshes with the toothed part 44*a* of the large diameter gear part 44 in the compound gear 40. The clutch mechanism 48 disengages the worm 47 and the pinion 46 when, for example, great torque is input from the downstream side to the upstream side of the transfer path. The clutch mechanism 48 thus prevents damage to the first cutter blade moving mechanism 24.

The downstream transfer mechanism 42 includes a cutter blade return gear 50 that meshes with the drive gear 32, and a transfer gear 51 that transfers rotation of the compound gear 40 to the cutter blade return gear 50. The drive gear 32, cutter blade return gear 50, and transfer gear 51 are located above the intermittent gear part 43 of the compound gear 40. The drive gear 32, cutter blade return gear 50, and transfer gear 51 are also arranged in this order from the front Y1 to the back Y2. The rotary shaft of the drive gear 32 is located in front Y1 of the compound gear 40 shaft, and the rotary shaft of the transfer gear 51 is located in back Y2 of the compound gear 40 shaft.

The transfer gear 51 can mesh with the intermittent teeth part 43*a* of the compound gear 40 (intermittent gear part 43). The cutter blade return gear 50 is an intermittent gear. The intermittent teeth part 50*a* of the cutter blade return gear 50 meshes with both the drive gear 32 and the transfer gear 51. Note that the cutter blade return gear 50 is a common gear with teeth around its full circumference.

The cutter blade return gear 50 also has a cutter blade return protrusion 50*b* at a position offset radially from its axis of rotation. The cutter blade return protrusion 50*b* is a fan shape increases in width circumferentially to the outside. The pivot point of the fan shape matches the axis of rotation of the cutter blade return gear 50.

The cutter blade return protrusion 50*b* can contact the compound gear-side protrusion 44*b* of the compound gear 40. More specifically, the circular path of the cutter blade return protrusion 50*b* when the cutter blade return gear 50 turns one revolution, and the circular path of the compound gear-side protrusion 44*b* of the compound gear 40 when the compound gear 40 turns one revolution, overlap in part. As a result, when the compound gear 40 turns one revolution, the compound gear-side protrusion 44*b* of the compound gear 40 contacts the cutter blade return gear 50 for a specific period only, and moves the cutter blade return protrusion 50*b* in the direction of rotation D1 of the compound gear 40. The period when the compound gear-side protrusion 44*b* of the compound gear 40 and the cutter blade return protrusion 50*b* touch is when the transfer gear 51 and the intermittent teeth part 43*a* of the compound gear 40 are not engaged, and the compound gear-side protrusion 44*b* of the compound gear 40 and the cutter blade return protrusion 50*b* do not touch when the transfer gear 51 and the intermittent teeth part 43*a* of the compound gear 40 are meshed.

Rotation of the compound gear 40 is transferred from the transfer gear 51 through the cutter blade return gear 50 to the drive gear 32 while the compound gear 40 to which rotation of the drive motor 31 is transferred turns one revolution and the intermittent teeth part 43*a* of the compound gear 40 and the transfer gear 51 are meshed. As a result, the drive gear 32 turns a specific angle of rotation in the first direction of rotation R1. The first cutter blade 21 therefore moves from the retracted position 21B to the forward position 21A.

While the compound gear 40 to which rotation of the drive motor 31 is transferred turns one revolution, the intermittent teeth part 43*a* of the compound gear 40 and the transfer gear 51 are disengaged, and the compound gear-side protrusion 44*b* of the compound gear 40 and the cutter blade return protrusion 50*b* of the cutter blade return gear 50 are touching, rotation of the compound gear 40 is transferred through the compound gear-side protrusion 44*b* and the cutter blade return protrusion 50*b* to the cutter blade return gear 50. As a result, the compound gear 40 turns the cutter blade return gear 50 when the compound gear 40 turns, and the cutter blade return gear 50 turns in the opposite direction as when rotation of the compound gear 40 is transferred through the transfer gear 51. As a result, while the compound gear-side protrusion 44*b* and the cutter blade return protrusion 50*b* are touching, the drive gear 32 turns only a specific angle of rotation in the second direction of rotation R2. The first cutter blade 21 therefore returns from the forward position 21A to the retracted position 21B.

A pair of coil springs 35 extend on the longitudinal axis Y at positions separated on the transverse axis X. The front end of each coil spring 35 is attached to the rack member 27, and the back end is attached to the cover side frame 28. The coil springs 35 stretch and store urging force when the first cutter blade 21 moves from the retracted position 21B to the forward position 21A. The first cutter blade moving mechanism 24 therefore moves the first cutter blade 21 from the retracted position 21B to the forward position 21A in resistance to the urging force of the coil springs 35. When the first cutter blade moving mechanism 24 moves the first cutter blade 21 from the forward position 21A to the retracted position 21B, movement of the first cutter blade 21 to the retracted position 21B is assisted by the stored urging force of the coil springs 35.

The platen roller 17, the upstream transfer mechanism 41 of the first cutter blade moving mechanism 24 (the transfer gear 51 and cutter blade return gear 50), the drive gear 32, rack member 27, first cutter blade 21, and coil springs 35 are supported by the cover side frame 28. The platen roller 17, upstream transfer mechanism 41, drive gear 32, rack member 27, first cutter blade 21, and coil springs 35 therefore rotate with the cover 8 and separate from the main case 6 when the cover 8 opens.

Second Cutter Blade Moving Mechanism

As shown in FIG. 4, at the contact position 22A where it can contact the first cutter blade 21, the second cutter blade 22 is inclined toward the retracted position 21B of the first cutter blade 21 (toward the back Y2) in the direction approaching the plane of motion 23 of the first cutter blade 21. In this inclined position, the cutting edge 22*a* of the second cutter blade 22 is on the plane of motion 23. By displacing the cutting edge 22*a* from this inclined position downward away from the plane of motion 23, the second cutter blade moving mechanism 25 moves the second cutter blade 22 from the contact position 22A to the release position 22B.

The second cutter blade moving mechanism 25 is assembled below the plane of motion 23 of the first cutter blade 21. As shown in FIG. 3 and FIG. 4, the second cutter blade moving mechanism 25 has a support mechanism 55 and a linkage mechanism 56. The support mechanism 55 supports the second cutter blade 22 rockably around a specific axis of rotation. The linkage mechanism 56 causes the second cutter blade 22 to rock synchronized to movement of the first cutter blade 21 by the first cutter blade moving mechanism 24.

The support mechanism 55 includes the support frame 29 that carries the second cutter blade 22, a support shaft 58 that rockably supports the support frame 29, and urging members 59 that urge the second cutter blade 22 to the contact position 22A by urging the support frame 29. The urging members 59 are coil springs in this example.

As shown in FIG. 3, the support frame 29 includes a cutter support part 61 and a linkage frame part 62. The cutter support part 61 extends on the transverse axis X and supports the second cutter blade 22 from below. The linkage frame part 62 extends down from the one side X1 side end of the cutter support part 61 on the transverse axis X. The linkage frame part 62 has a front frame part 62*a* that extends down, a middle frame part 62*b* that extends to the back Y2 from the bottom end of the front frame part 62*a*, and a back frame part 62*c* that extends up from the back end part of the middle frame part 62*b*. A cam follower 29*a* that can contact the cam 44*c* of the compound gear 40 is disposed at the top end of the back frame part 62*c*.

The support shaft 58 passes through the front top part of the front frame part 62*a* on the transverse axis X. The support shaft 58 is the rotary shaft of the second cutter blade 22, and the axis of the support shaft 58 is the rocking axis (axis of rotation) of the second cutter blade 22. The urging members 59 urge the front top part of the front frame part 62*a* that is located on the opposite side of the support shaft 58 as the cutting edge 21*a* of the second cutter blade 22 down.

The cam follower 29*a* of the support frame 29 and the cam 44*c* of the compound gear 40 embody the linkage mechanism 56. While the compound gear 40 turns one revolution and the cam follower 29*a* and cam 44*c* of the compound gear 40 are not touching, the support frame 29 is urged in the counterclockwise S1 direction indicated by the arrows in FIG. 3 and FIG. 4 around the support shaft 58 by the urging members 59. When the support frame 29 is urged counterclockwise S1, the lift guides 21*c* of the second cutter blade 22 contact the lift guides 21*c* of the first cutter blade 21 from below. The second cutter blade 22 is therefore set to the contact position 22A at an angle. When the second cutter blade 22 is in the contact position 22A, the second cutter blade 22 is pushed against the first cutter blade 21 by the urging force of the urging members 59.

When the compound gear 40 turns and the cam follower 29*a* of the support frame 29 and the cam 44*c* of the compound gear 40 contact, the back frame part 62*c* (see FIG. 40) is displaced downward in resistance to the urging force of the urging members 59. As a result, the support frame 29 rotates clockwise S2 as shown by the arrows in FIG. 3 and FIG. 4 on the support shaft 58. As a result, the cutting edge 21*a* moves down from the plane of motion 23 and the second cutter blade 22 moves to the release position 22B not touching the first cutter blade 21. The second cutter blade 22 remains in the release position 22B while the cam follower 29*a* is in contact with the cam 44*c* of the compound gear 40.

The second cutter blade moving mechanism 25 sets the second cutter blade 22 to the contact position 22A before the first cutter blade moving mechanism 24 moves the first cutter blade 21 from the retracted position 21B to the forward position 21A. The second cutter blade moving mechanism 25 also moves the second cutter blade 22 to the release position 22B before the first cutter blade moving mechanism 24 moves the first cutter blade 21 from the forward position 21A to the retracted position 21B.

Cutting Operation

The operation whereby the cutter 15 cuts the recording paper 3 is described next with reference to FIG. 5 to FIG. 9.

Figure 5:
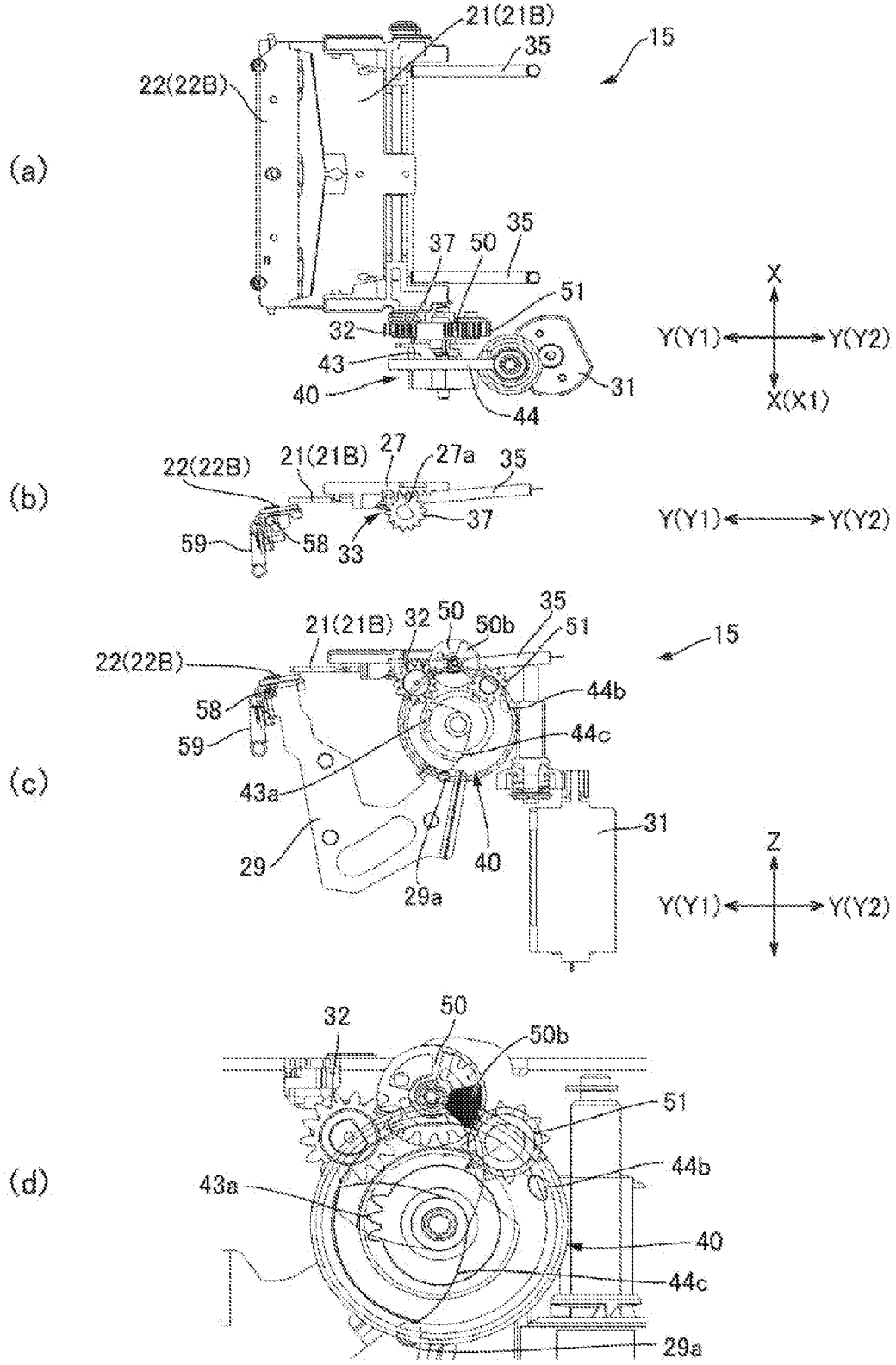
FIG. 5 illustrates the recording paper cutting operation of the cutter.
Figure 6:
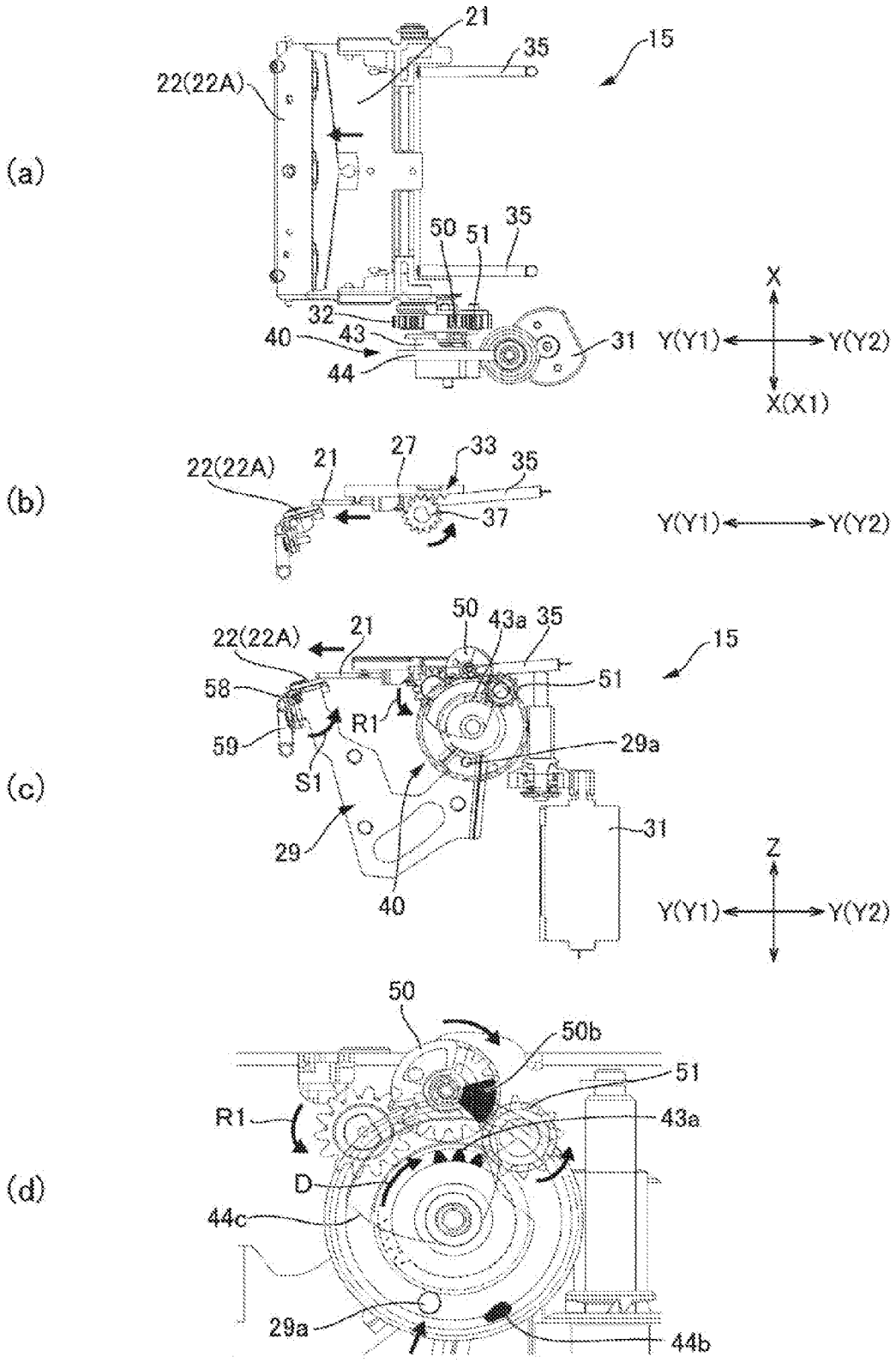
FIG. 6 illustrates the recording paper cutting operation of the cutter.
Figure 7:
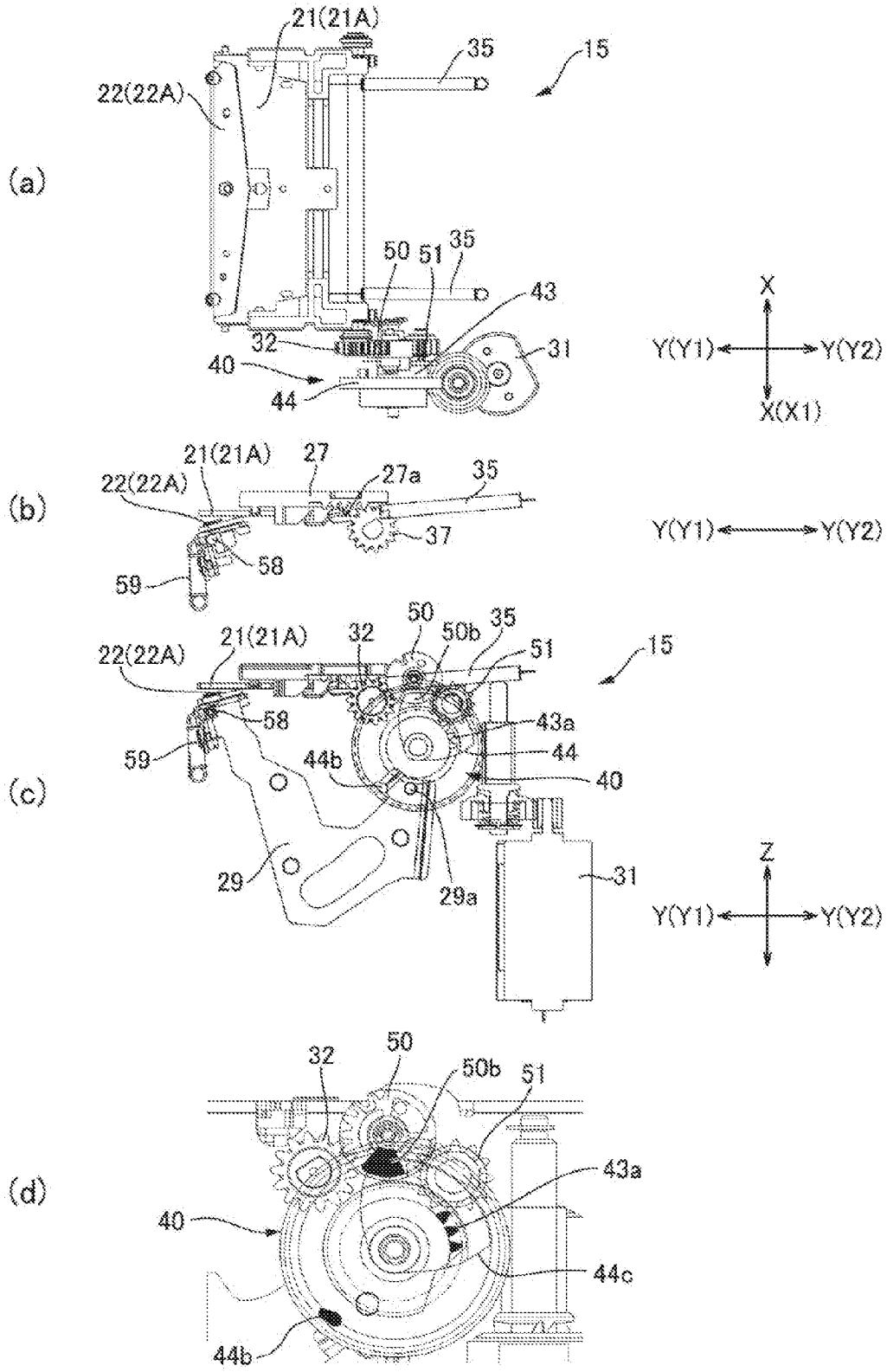
FIG. 7 illustrates the recording paper cutting operation of the cutter.
Figure 8:
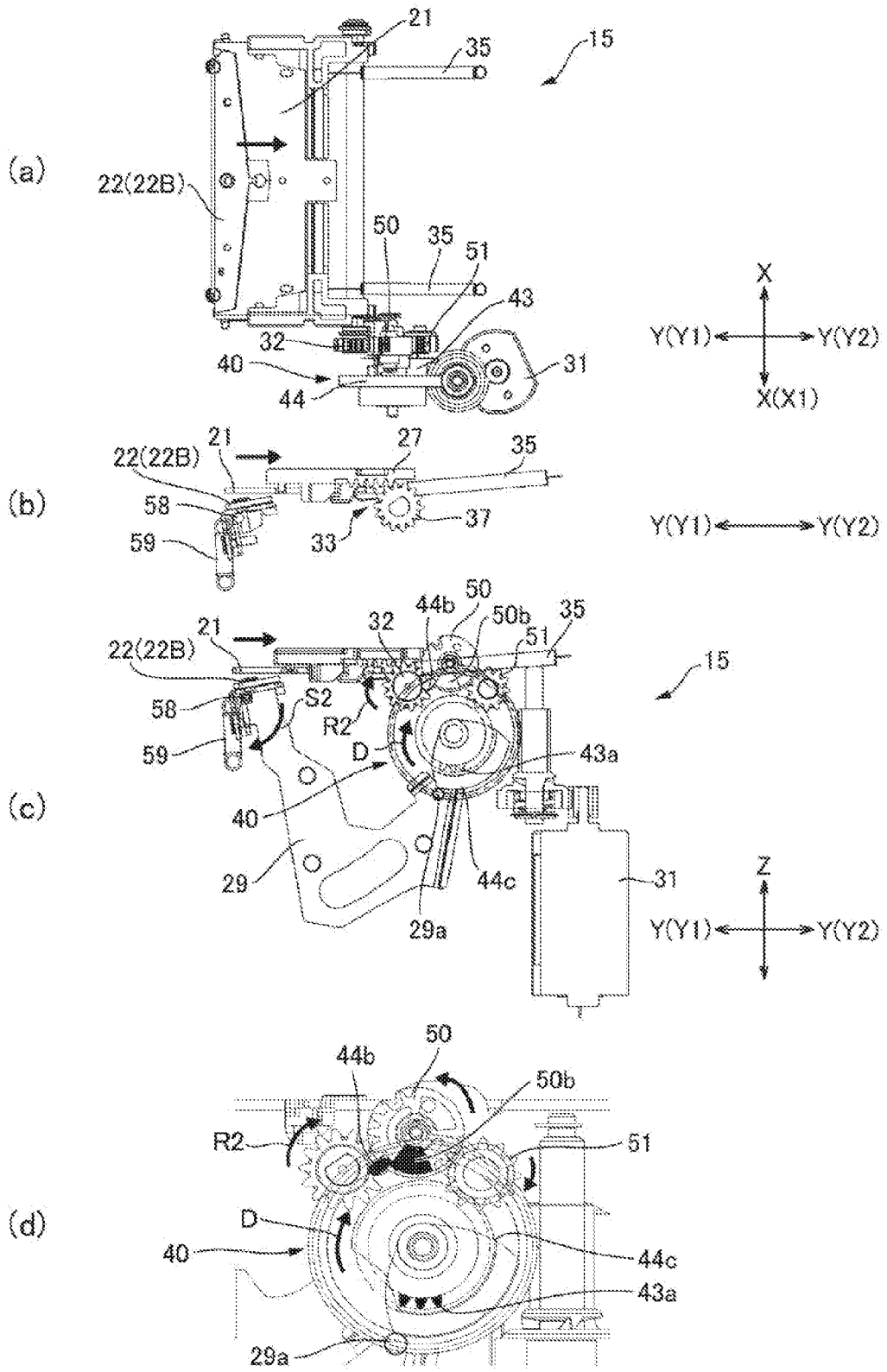
FIG. 8 illustrates the recording paper cutting operation of the cutter.
Figure 9:
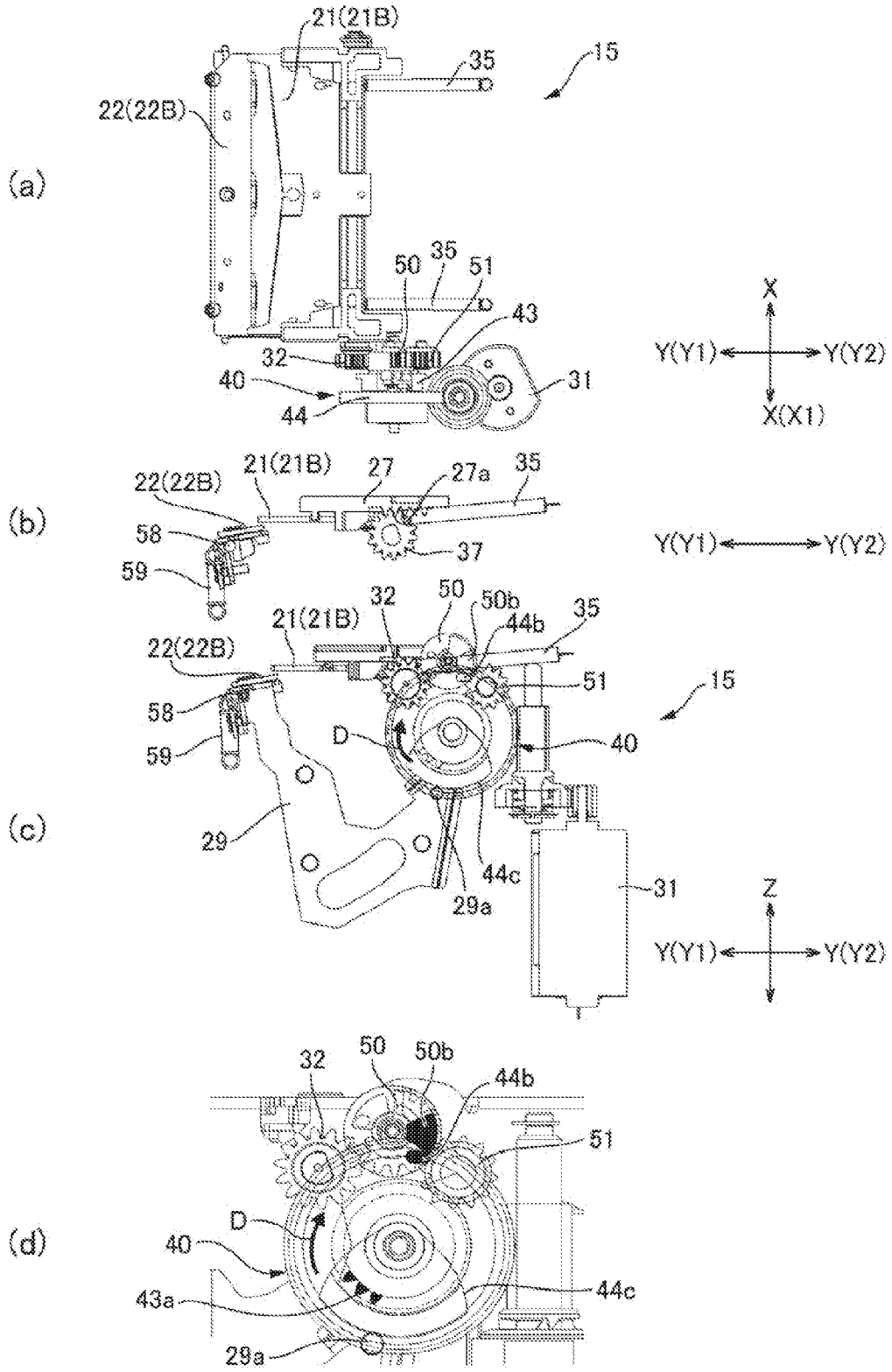
FIG. 9 illustrates the recording paper cutting operation of the cutter.

FIG. 5 shows the cutter 15 in the standby position. FIG. 6 shows immediately before the first cutter blade 21 starts moving. FIG. 7 shows the first cutter blade 21 at the forward position 21A. FIG. 8 shows the cutter 15 immediately after cutting the recording paper 3. FIG. 9 shows the first cutter blade 21 at the retracted position 21B. In each of the figures, view (a) is a plan view of the cutter 15; view (b) is a section view of the cutter 15 through a plane passing through the pinion 37 of the rotary to linear conversion mechanism 33; view (c) is a side view of the cutter 15; and view (d) is an enlarged view of the compound gear 40 and vicinity. In views (c) and (d), the intermittent teeth part 43*a*, compound gear-side protrusion 44*b*, cutter blade return protrusion 50*b*, cam 44*c*, and the cam follower 29*a* are shown to clearly illustrate their positions.

When the printer 1 is off and while the printer 1 is in the standby mode waiting to receive print data, the cutter 15 is in the standby position. In the standby position, as shown in FIG. 5 (*a*), the first cutter blade 21 is in the retracted position 21B. As shown in FIG. 5 (*b*), the pinion 37 coaxial to the drive gear 32 is meshed with the front end part of the rack 27*a* of the rack member 27. As shown in FIGS. 5 (*c*) and (*d*), the intermittent teeth part 43*a* of the compound gear 40 is at an angle separated from the transfer gear 51, and is not meshed with the transfer gear 51. The cutter blade return protrusion 50*b* of the cutter blade return gear 50 is at a position separated from the path of movement of the compound gear-side protrusion 44*b* of the compound gear 40, and the compound gear-side protrusion 44*b* is not touching the cutter blade return protrusion 50*b*. As shown in FIG. 5 (*c*), the cam follower 29*a* of the support frame 29 that supports the second cutter blade 22 is in contact with the cam 44*c* of the compound gear 40. As a result, the back frame part 62*c* (see FIG. 4) of the support frame 29 is pushed down against the urging force of the coil springs 35, and the second cutter blade 22 is at the release position 22B separated from the first cutter blade 21.

When print data is supplied from an external device, the printer 1 drives the conveyance motor 18 to turn the platen roller 17 and convey the paper roll 2 set in the conveyance path 16 at a specific speed. The printer 1 also drives the printhead 14 to print on the recording paper 3 as it passes the printing position A. When printing is completed, the printer 1 drives the drive motor 31 a specific drive time in the same rotational direction. As a result, the cutter 15 operates and cuts the recorded part of the printed recording paper 3.

When the drive motor 31 is driven, the compound gear 40 starts turning in the direction of rotation D1 (clockwise). When the compound gear 40 turns, contact between the cam follower 29*a* of the support frame 29 and the cam 44*c* of the compound gear 40 is immediately released. As a result, the support frame 29 turns counterclockwise S1 on the support shaft 58 due to the urging force of the urging members 59 (FIG. 6 (*c*)). As a result, the second cutter blade 22 moves to the cutting edge 22*a* where it can contact the first cutter blade 21.

As shown in FIG. 6, when the compound gear 40 turns further, the intermittent teeth part 43*a* of the compound gear 40 meshes with the transfer gear 51 a specific time after driving the drive motor 31 starts. In this example, the intermittent teeth part 43*a* meshes with the transfer gear 51 when the intermittent teeth part 43*a* has turned at least 90 degrees on the axis of rotation of the compound gear 40. When the intermittent teeth part 43*a* of the compound gear 40 and the transfer gear 51 mesh, as shown in FIG. 6, view (d), the transfer gear 51 turns counterclockwise. The cutter blade return gear 50 meshed with the transfer gear 51 also turns clockwise. The drive gear 32 meshed with the cutter blade return gear 50 turns counterclockwise in the first direction of rotation R1. While the intermittent teeth part 43*a* of the compound gear 40 is meshed with the transfer gear 51, the drive gear 32 turns a specific rotational angle in the first direction of rotation R1.

Rotation of the drive gear 32 a specific angle in the first direction of rotation R1 is converted by the rotary to linear conversion mechanism 33 to linear motion of the first cutter blade 21 to the front Y1. The first cutter blade 21 therefore moves a specific distance from the retracted position 21B to the forward position 21A. As a result, the first cutter blade 21 passes the cutting position B on the conveyance path 16 while the knife edge 21*b* is touching the knife edge 22*b* of the second cutter blade 22, and reaches the forward position 21A. The recording paper 3 disposed to the cutting position B is thus cut.

As shown in FIG. 7, when the first cutter blade 21 reaches the forward position 21A, the intermittent teeth part 43*a* of the compound gear 40 and the transfer gear 51 are no longer meshed. As a result, because rotation of the compound gear 40 is not transferred to the drive gear 32, the first cutter blade 21 stops moving at the forward position 21A. When the first cutter blade 21 is at the forward position 21A, the drive gear 32 meshes with the back end part of the rack 27*a* of the rack member 27. Note that while the first cutter blade 21 moves to the forward position 21A, the coil springs 35 stretch and store urging force.

As shown in FIG. 7, views (c) and (d), the cutter blade return protrusion 50*b* of the cutter blade return gear 50 that transfers rotation of the transfer gear 51 to the drive gear 32 is positioned on the path of movement of the compound gear-side protrusion 44*b* of the compound gear 40 while the first cutter blade 21 is moving from the retracted position 21B to the forward position 21A (while the intermittent teeth part 43*a* of the compound gear 40 and the transfer gear 51 are meshed).

As shown in FIG. 8, when the compound gear 40 then turns further, the cam 44*c* of the compound gear 40 and the cam follower 29*a* of the support frame 29 that supports the second cutter blade 22 contact. As a result, as shown in FIG. 8, view (c), the back frame part 62*c* (see FIG. 4) of the support frame 29 is pushed down, and the support frame 29 rocks clockwise S2 on the support shaft 58 (see FIG. 4). As a result, the second cutter blade 22 moves to the release position 22B separated from the first cutter blade 21.

After the second cutter blade 22 reaches the release position 22B, the compound gear-side protrusion 44*b* of the compound gear 40 contacts the cutter blade return protrusion 50*b* of the cutter blade return gear 50. When the compound gear-side protrusion 44*b* and the cutter blade return protrusion 50*b* contact, engagement of the intermittent teeth part 43*a* of the compound gear 40 and the transfer gear 51 is released. The cutter blade return gear 50 therefore rotates freely and the cutter blade return gear 50 rotates with the compound gear 40 while the compound gear-side protrusion 44*b* and the cutter blade return protrusion 50*b* remain in contact. As a result, the cutter blade return gear 50 rotates counterclockwise as shown in FIG. 8 (*d*), and turns the drive gear 32 clockwise in the second direction of rotation R2. While the compound gear-side protrusion 44*b* and the cutter blade return protrusion 50*b* remain in contact, the drive gear 32 turns a specific angle in the second direction of rotation R2.

Rotation of the drive gear 32 a specific angle in the second direction of rotation R2 is converted by the rotary to linear conversion mechanism 33 to the linear motion of the first cutter blade 21 to the back Y2. The first cutter blade 21 therefore moves a specific distance from the forward position 21A to the retracted position 21B. When the first cutter blade 21 moves to the retracted position 21B, its movement is assisted by the urging force of the coil springs 35.

As shown in FIG. 9, when the compound gear 40 rotates further and the cutter blade return protrusion 50*b* of the cutter blade return gear 50 moves to a position removed from the path of the compound gear-side protrusion 44*b* of the compound gear 40, contact between the compound gear-side protrusion 44*b* and the cutter blade return protrusion 50*b* is released. As a result, because counterclockwise rotation of the cutter blade return gear 50 stops, rotation of the drive gear 32 in the second direction of rotation R2 also stops. As a result, the first cutter blade 21 stops moving at the retracted position 21B. When the first cutter blade 21 is in the retracted position 21B, the drive gear 32 is meshed with the front end of the rack 27*a* of the rack member 27.

The drive motor 31 then stops. More specifically, when the drive time of the drive motor 31 reaches a specific drive time after the first cutter blade 21 is set to the retracted position 21B, the drive motor 31 stops. As a result, the cutter 15 returns to the standby position shown in FIG. 5.

In the standby position shown in FIG. 5, the intermittent teeth part 43*a* of the compound gear 40 is at an angular position separated from the transfer gear 51, and not meshed with the transfer gear 51. The cutter blade return protrusion 50*b* of the cutter blade return gear 50 is at a position separated from the path of movement of the compound gear-side protrusion 44*b* of the compound gear 40, and the compound gear-side protrusion 44*b* is not in contact with the cutter blade return protrusion 50*b*. The cam follower 29*a* of the support frame 29 that supports the second cutter blade 22 is in contact with the cam 44*c* of the compound gear 40. As a result, the back frame part 62*c* of the support frame 29 is pushed down against the urging force of the coil springs 35, and the second cutter blade 22 is at the release position 22B separated from the first cutter blade 21.

When the printer 1 is in this standby position and the cover 8 is opened to the open position 8B to load a paper roll 2, for example, the platen roller 17, first cutter blade 21, rack member 27, drive gear 32, upstream transfer mechanism 41 (cutter blade return gear 50 and transfer gear 51), and coil springs 35 move with the cover 8, but when in the standby position, the intermittent teeth part 43*a* of the compound gear 40 are in a position not meshed with the transfer gear 51. As a result, the operation of opening the cover 8 is not obstructed by meshing of the transfer gear 51 with the intermittent teeth part 43*a* of the compound gear 40.

In the standby position, the intermittent teeth part 43*a* of the compound gear 40 is positioned not meshing with the transfer gear 51, and the compound gear-side protrusion 44*b* is positioned not in contact with the cutter blade return protrusion 50*b*. Therefore, when the cover 8 is closed from the open position 8B to the closed position 8A, the transfer gear 51 and the intermittent teeth part 43*a* of the compound gear 40 do not collide, and the cutter blade return protrusion 50*b* and the compound gear-side protrusion 44*b* do not collide. In addition, because the second cutter blade 22 is at the release position 22B, the knife edge 22*b* of the second cutter blade 22 is below the plane of motion 23 of the first cutter blade 21. Therefore, even when the cover 8 is at the open position 8B, the knife edge 22*b* of the second cutter blade 22 does not protrude from the main case 6, and is safe.

Operating Effect

When the compound gear-side protrusion 44*b* of the compound gear 40 to which rotation of the drive motor 31 is transferred contacts the cutter blade return protrusion 50*b* of the cutter blade return gear 50 and this contact is maintained, the cutter blade return gear 50 rotates in unison with the compound gear 40 and the drive gear 32 turns a specific rotational angle in the second direction of rotation R2. As a result, the first cutter blade 21 moves from the forward position 21A to the retracted position 21B. The first cutter blade 21 can therefore be stopped at the retracted position 21B without stopping the drive motor 31. The first cutter blade 21 can therefore be reliably set to the retracted position 21B regardless of any deviation in the stopping position of the drive motor 31.

While the intermittent teeth part 43*a* of the compound gear 40 and the transfer gear 51 are meshed, the drive gear 32 turns a specific rotational angle in the first direction of rotation R1, and the first cutter blade 21 therefore moves from the retracted position 21B to the forward position 21A. The first cutter blade 21 can therefore be moved reliably between the forward position 21A and the retracted position 21B. Assuring a longer than necessary stroke in the movement of the first cutter blade 21 is therefore not necessary. A small cutter 15 can therefore be provided.

The cutter blade return protrusion 50*b* in this example is disposed on the outside circumference side of the intermittent teeth part 43*a* of the compound gear 40. As a result, the tangential velocity of the cutter blade return protrusion 50*b* is greater than the tangential velocity of the intermittent teeth part 43*a*. The first cutter blade moving mechanism 24 can therefore return the first cutter blade 21 from the forward position 21A to the retracted position 21B at a faster speed than when moving the first cutter blade 21 from the retracted position 21B to the forward position 21A.

The rotary to linear motion conversion mechanism 33 that moves the first cutter blade 21 in this example is a rack and pinion mechanism. By using a rack and pinion mechanism, the rotational angle of the drive gear 32 and the linear speed of the first cutter blade 21 can be desirably controlled, and the first cutter blade 21 can be moved more accurately than when using a linkage mechanism for the rotary to linear conversion mechanism 33.

Other Embodiments

The drive gear 32 may also function as the transfer gear 51. More specifically, the intermittent teeth part 43*a* of the compound gear 40 may be meshed with the drive gear 32. This enables eliminating the transfer gear 51 and reducing the number of parts.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A cutter blade drive mechanism that moves a cutter blade reciprocally between a forward position where a sheet medium is cut and a retracted position separated from the forward position, comprising:

a drive gear;

a rotary-to-linear-motion conversion mechanism that converts rotation of the drive gear to linear motion moving the cutter blade forward and back;

a drive motor; and a rotation transfer mechanism that transfers rotation in a driving direction from the drive motor to the drive gear to selectively rotate the drive gear in a first direction of rotation, and transfers rotation in the same driving direction from the drive motor to the drive gear to selectively rotate the drive gear in a second direction of rotation opposite the first direction of rotation;

wherein the cutter blade moves from the retracted position to the forward position by the drive motor rotating in the driving direction to drive rotation of the drive gear, via the rotation transfer mechanism, by a first specific rotational angle in the first direction of rotation, and the cutter blade moves from the forward position to the retracted position by the drive motor rotating in the same driving direction to drive rotation of the drive gear, via the rotation transfer mechanism, by a second specific rotational angle in the second direction of rotation opposite the first direction of rotation.

2. The cutter blade drive mechanism described in claim 1, wherein:

the rotation transfer mechanism includes a cutter blade return gear that meshes with the drive gear, an intermittent gear to which rotation from the drive motor is transferred, and a transfer gear that transfers rotation of the intermittent gear to the cutter blade return gear;

the cutter blade return gear has a non-tooth protrusion at a position separated radially from its axis of rotation; and the intermittent gear has a non-tooth contact part at a position separated radially from its axis of rotation and that can contact the protrusion.

3. The cutter blade drive mechanism described in claim 2, wherein:

the drive gear is also the transfer gear.

4. The cutter blade drive mechanism described in claim 1, wherein:

the rotary-to-linear-motion conversion mechanism is a rack and pinion mechanism.

5. The cutter blade drive mechanism described in claim 1, further comprising:

an urging member attached to the cutter blade and that directly urges the cutter blade from the forward position to the retracted position.

6. The cutter blade drive mechanism described in claim 1, wherein a magnitude of the first specific rotational angle is substantially equal to a magnitude of second specific rotation angle.

7. A printer comprising:

the cutter blade drive mechanism described in claim 6;

a printhead; and a conveyance mechanism that conveys sheet media through a conveyance path passing the printing position of the printhead and the cutting position of the cutter.

8. A cutter comprising:

the cutter blade drive mechanism described in claim 1;

a first cutter blade that is moved between the forward position and the retracted position by the cutter blade drive mechanism; and a second cutter blade that contacts the first cutter blade at the forward position.

9. The cutter blade drive mechanism described in claim 1, wherein:

the rotation transfer mechanism includes a cutter blade return gear that meshes with the drive gear, an intermittent gear to which rotation from the drive motor is transferred, and a transfer gear positioned to mesh with the intermittent gear and to selectively transfer rotation of the intermittent gear to the cutter blade return gear;

the cutter blade return gear has a first non-tooth protrusion at a position separated radially from its axis of rotation;

the intermittent gear has a second non-tooth protrusion at a position separated radially from its axis of rotation, the second non-tooth protrusion being positioned to contact the first non-tooth protrusion of the cutter blade return gear;

wherein:

when the transfer gear meshes with the intermittent gear, the transfer gear transfers rotation of the intermittent gear to the cutter blade return gear to rotate the drive gear in the first direction; and when the first non-tooth protrusion of the cutter blade return gear contacts the second non-tooth protrusion of the intermittent gear, the transfer gear is disengaged from the intermittent gear and the cutter blade return gear rotates the drive gear in the second direction.

10. A cutter blade drive mechanism that moves a cutter blade reciprocally between a forward position where a sheet medium is cut and a retracted position separated from the forward position, comprising:

a drive gear;

a rotary-to-linear-motion conversion mechanism that converts rotation of the drive gear to linear motion moving the cutter blade forward and back;

a drive motor; and a rotation transfer mechanism that transfers rotation from the drive motor to the drive gear;

wherein the cutter blade moves from the retracted position to the forward position by rotation of the drive gear by a first specific rotational angle in a first direction of rotation, and moves from the forward position to the retracted position by rotation of the drive gear by a second specific rotational angle in a second direction of rotation opposite the first direction of rotation;

wherein:

the rotation transfer mechanism includes a cutter blade return gear that meshes with the drive gear, an intermittent gear to which rotation from the drive motor is transferred, and a transfer gear that transfers rotation of the intermittent gear to the cutter blade return gear;

the cutter blade return gear has a protrusion at a position separated radially from its axis of rotation; and the intermittent gear has a contact part at a position separated radially from its axis of rotation and that can contact the protrusion; and wherein:

the intermittent gear is not continuously meshed with the transfer gear, and the intermittent gear has a toothed part that intermittently meshes with a toothed part of the transfer gear;

the drive gear turns the first specific rotational angle in the first direction of rotation in conjunction with rotation of the intermittent gear while the toothed parts of the intermittent gear and the transfer gear are meshed, and when the toothed parts of the intermittent gear and the transfer gear are not meshed and the contact part of the intermittent gear is in contact with the protrusion of the cutter blade return gear, the drive gear turns the second specific rotational angle in the second direction of rotation by the intermittent gear turning the cutter blade return gear.

11. The cutter blade drive mechanism described in claim 10, wherein:

the protrusion is disposed closer to the outside circumference of the intermittent gear than the toothed part.

12. A cutter comprising:

the cutter blade drive mechanism described in claim 10;

a first cutter blade that is moved between the forward position and the retracted position by the cutter blade drive mechanism; and a second cutter blade that contacts the first cutter blade at the forward position.

13. A printer comprising:

the cutter blade drive mechanism described in claim 10;

a printhead; and a conveyance mechanism that conveys sheet media through a conveyance path passing the printing position of the printhead and the cutting position of the cutter.

* * * * *